US007032252B2

(12) United States Patent
Mercado

(10) Patent No.: US 7,032,252 B2
(45) Date of Patent: Apr. 25, 2006

(54) DRAIN PLUNGER HANDLE

(76) Inventor: Abel Mercado, 1717 S. Country Club La., Fresno, CA (US) 93727

( * ) Notice: Subject to any disclaimer, the term of this patent is extended or adjusted under 35 U.S.C. 154(b) by 78 days.

(21) Appl. No.: 10/712,564

(22) Filed: Nov. 12, 2003

(65) Prior Publication Data

US 2005/0097663 A1 May 12, 2005

(51) Int. Cl.
*E03D 11/00* (2006.01)

(52) U.S. Cl. ..... 4/255.11

(58) Field of Classification Search ..... 4/255.01, 4/255.05, 255.11

See application file for complete search history.

(56) References Cited

U.S. PATENT DOCUMENTS

| | | | | |
|---|---|---|---|---|
| 4,669,131 | A | 6/1987 | Barlow | |
| 5,249,311 | A * | 10/1993 | Rau | 4/255.05 |
| 5,384,918 | A * | 1/1995 | Leighton et al. | 4/255.05 |
| D381,146 | S | 7/1997 | Tash | |
| D381,147 | S | 7/1997 | Tash | |
| D383,935 | S | 9/1997 | Zawalsky | |
| 6,035,455 | A | 3/2000 | Rankovic | |
| 6,145,135 | A | 11/2000 | Pool et al. | |
| 6,484,326 | B1 * | 11/2002 | Leaphart et al. | 4/255.01 |
| D466,661 | S | 12/2002 | Schmidt et al. | |
| 6,550,074 | B1 | 4/2003 | Allenbaugh et al. | |

* cited by examiner

*Primary Examiner*—Tuan Nguyen
(74) *Attorney, Agent, or Firm*—Richard A. Ryan

(57) ABSTRACT

A drain plunger handle for use with a plunger head to remove obstructions in a plumbing system. The drain plunger handle comprises a handle body, a pair of handle members and a head connector for connecting to the plunger head. The handle members are vertically offset from each other and substantially within the same general vertical plane to provide an ergonomically beneficial grip on the drain plunger handle when used to clear the obstruction. The handle members can be slidably attached to the handle body to allow the user to adjust the amount of vertical offset. The head connector can include a connector body and a threaded post for threadably connecting to the plunger head. The present plunger handle allows the user to comfortably and easily apply more force to the plunger head so as to supply the necessary positive and negative pressure pulses to dislodge the obstruction.

10 Claims, 2 Drawing Sheets

DRAIN PLUNGER HANDLE

CROSS-REFERENCE TO RELATED APPLICATIONS

Not Applicable.

BACKGROUND OF THE INVENTION

A. Field of the Invention

The field of the present invention relates generally to plumbing apparatuses used to clear clogged drains. More specifically, the present invention relates to drain plunger plumbing apparatuses that are used to manually force air into a plumbing system to clear a clogged drain. Even more specifically, the present invention relates to an improved handle for drain plungers that is configured to be easier and more effective to use to clear clogged drains.

B. Background

Most plumbing systems have one or more fixtures, such as sinks, toilets, showers, bathtubs and the like, include a drain that allows fluid to drain from the fixture into the plumbing system. Unfortunately, it is not uncommon for the drains to become clogged, leaving fluid and other materials stuck in the fixture. Most clogged drains result from an obstruction in the drain pipes below the location of the entrance into the drain in the fixture. Most household clogged drains result from the insertion of paper, soap hair, bodily waste, lotion and other materials that are intentionally, with an intent of disposing of the material, or accidently placed in the drain opening. Industrial and manufacturing drains can be clogged with some of these same materials, as well as a variety of other materials used in the industrial or manufacturing processes.

A number of general solutions exist for clearing a clogged drain, including the use of chemical solutions, plungers and wire devices. Chemical solutions can be effective for the right type of clog. However, the chemicals utilized in most commercially available solutions are expensive and known to be somewhat dangerous. In addition, once chemicals are poured into the drain to release a clog, they become a part of the wastewater that must be treated and/or disposed of by municipal authorities. For these reasons, many people prefer not to initially utilize chemical solutions to clear a clog in the hope that the use of chemicals can be avoided altogether. The use of plungers is perhaps the most common method of unclogging a clogged drain. In general, plungers are configured to rapidly force a quantity of air into the drain to dislodge the clog and clear the drain for use. Wire devices are typically utilized by professionals who have experience in guiding the wire through the drain into the plumbing system so as to break-up the clog and allow the drain to be put back into use.

Plungers for clearing clogged drains have been around for quite some time. The standard plunger comprises a generally straight, smooth rod or pole-like handle with a flexible cup at one end that is configured to cover the typical fixture drain and force compressed air into the plumbing system when the user pushes down on the plunger handle. The standard plunger handle is configured to be short enough that the user can grasp his or her hand around the body and top of the handle to push down on the cup and force air through the drain and into the plumbing system. Depending on the extent of the clog, the amount of manual force required to release the clog can be somewhat significant and require multiple pushes on the plunger cup. For some people, the amount of force and the number of repetitions necessary can make this effort somewhat difficult and, in some cases, virtually impossible to accomplish. Some of the difficulty with utilizing the standard plunger is a result of the plunger handle configuration. From an ergonomic standpoint, the standard handle is not particularly well configured for obtaining a good grasp on the handle and forcing it downward to cause the cup to force air into the drain. As a result of the inability to effectively grasp the plunger handle, the typical user is not able to apply significant force to the plunger coup and some drain obstructions that could otherwise be cleared with a plunger are not able to be cleared, thereby requiring the use of drainage chemicals and/or the use of a professional plumber.

The disadvantages of the standard plunger has resulted in a number of improved plunger devices. Some of these plungers, such those disclosed in U.S. Pat. No. D466,661 to Schmidt, et al. and U.S. Pat. No. D383,935 to Zawalsky, utilize an plunger handle having a slightly improved shape that appears to be configured to be easier to use. U.S. Pat. Nos. D381,146 and D381,147, both to Tash, disclose a toilet plunger having a flexible accordion plunger head attached to a plunger handle also having an accordion section that acts to drive compressed air into the fixture drain. U.S. Pat. No. 6,145,134 to Pool, et al., discloses a drain plunger having a hollow helically-shaped plunger cup and a handle that is used to impart a vortex motion to the water expelled from the plunger into the plumbing system. Other known plungers, as exemplified by U.S. Pat. No. 6,550,074 to Allenbaugh, et al. and U.S. Pat. No. 6,035,455 to Rankovic, utilize mechanical devices to forcibly remove drain obstructions by providing a relatively sudden burst of compressed gas to act against the obstruction and cause it to move and/or break-up. The available mechanical drain plungers are generally harder to use, more expensive and, in some cases, more difficult to store when not in use. Such devices that are bulky are also limited in the situations in which they can be used, as it may be difficult in these cases to get the drain plunger into position over the drain. As is well known, drain plungers that utilize relatively complicated mechanisms are more likely to have a tendency to malfunction or otherwise break.

Although the prior art discloses a number of drain plunger handles, there are certain characteristics of the known drain plunger handles that limit their complete acceptance, usefulness and/or cost effectiveness. Accordingly, there is a need for an improved plunger handle that can be used with a plunger cup to easily and quickly clear drain obstructions. The preferred plunger handle should reduce the amount of physical effort necessary to clear the obstruction and be adaptable for use with a variety of different types of plunger cups. In addition, the preferred plunger handle should be generally devoid of mechanical apparatuses or moving components to make it easier and more affordable for the typical user.

SUMMARY OF THE INVENTION

The drain plunger handle of the present invention solves the problems and provides the benefits identified above. That is to say, the present invention discloses a plunger handle that is particularly configured to be easy to use to provide sufficient force to remove many drain obstructions that may not otherwise be able to be removed. The drain plunger handle of the present invention allows the user to ergonomically provide much greater downward force on the handle so as to cause the plunger cup to rapidly expel air against the drain obstruction. The plunger handle of the present invention is relatively inexpensive to manufacture and is adaptable for a variety of different types of plunger cups. Because the present plunger handle is not bulky and does not require additional components, it provides an easy to store drain plunger.

In the primary aspect of the present invention, the drain plunger handle comprises an elongated handle body having a first end and a second end, a first handle member attached to the handle body, a second handle member attached to the handle body and a head connector at the first end of the handle body. The first and second handle members are attached to the handle body so as to have a vertical offset therebetween and to substantially be in the same vertical plane. The head connector is configured to connect the handle body to the plunger head, preferably in a manner that allows the plunger head to be relatively easily removed from plunger handle. In the preferred embodiment, the first and second handle members have connectors attaching the handle members to the handle body. In a preferred embodiment, the handle body, handle members and head connector are integral, being manufactured by a molding process out of moldable polymer. In another configuration, the connectors have a securing mechanism for securing the handle members to the handle body. In yet another configuration the handle members are slidably attached to the handle body. The head connector can comprises a connector body attached to the handle body and a threaded post extending outwardly from the connector body along the longitudinal axis of the handle body. The threaded post being adapted to be threadably received in the plunger head.

Accordingly, the primary objective of the present invention is to provide an improved drain plunger handle that provides the advantages discussed above and that overcomes the disadvantages and limitations associated with presently available drain plunger handles.

It is also an important objective of the present invention to provide a drain plunger handle that is easy to utilize to provide sufficient force at the plunger head to force air and fluid into a plumbing system to remove a drain obstruction located therein.

It is also an important objective of the present invention to provide a drain plunger handle that is adaptable to a wide range of plunger heads.

It is also an important objective of the present invention to provide a drain plunger handle that is generally devoid of mechanical apparatuses so that it can be inexpensively manufactured.

It is also an important objective of the present invention to provide a drain plunger handle that is not bulky.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the drawings which illustrate the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, and particularly with reference to the embodiments of the drain plunger handle of the present invention illustrated in the figures, the preferred embodiments of the present invention are set forth below. The enclosed figures and drawings are merely illustrative of the preferred embodiments and represent several different ways of configuring the present invention. Although specific components, materials, configurations and uses of the present invention are illustrated and set forth in this disclosure, it should be understood that a number of variations to the components and to the configuration of those components described herein and in the accompanying figures can be made without changing the scope and function of the invention set forth herein.

Figure 1:
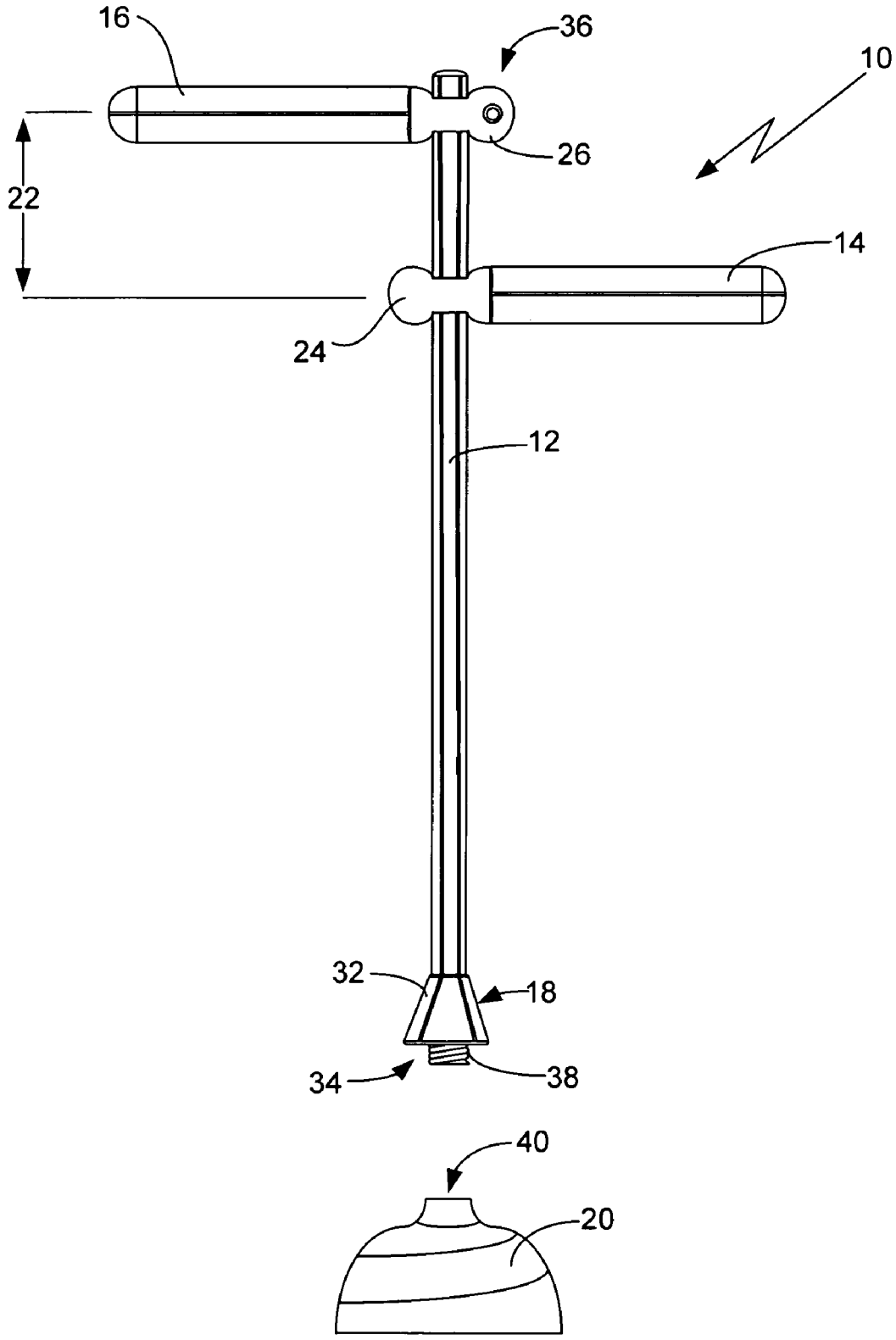
FIG. 1 is a front view of the drain plunger handle of the present invention with a plunger head adapted for use with the drain plunger handle.

A preferred embodiment of the drain plunger handle of the present invention, identified generally as 10 in the figures, primarily comprises an elongated handle body 12, first handle member 14, second handle member 16 and head connector 18, as best shown in FIG. 1. Head connector 18 is configured to attach to plunger head 20, which is shown in FIG. 1 as one common type of plunger head that is suitable for use with drain plunger handle 10 of the present invention. As is known in the art, plunger head 20 is configured to provide a substantially sealed connection around a fixture drain (not shown). Generally, the typical plunger head 20 is manufactured out of a flexible material suitable for providing a flexible sealing edge around the drain and for providing both positive and negative surge of water in the plumbing system (not shown) to dislodge obstructions therein. This is accomplished by providing a plunger head 20 that is made out of a pliable resilient material, such as polyurethane, which is a relatively costly material, or Buna-N rubber, a more common and less costly material. These types of plunger heads can be made from known injection molding and vulcanizing processes. Although one configuration of plunger head 20 is shown in the drawings, those skilled in the art will know that many different configurations of plunger head 20 can be adapted to work with the drain plunger handle 10 of the present invention. For instance, plunger head 20 can be the conventional type, as shown, or the accordion type of plunger heads known in the art. As explained below, however, head connector 18 and plunger head 20 will have to be suitable for cooperative engagement so that drain plunger handle 10 can be utilized to remove an obstruction in the plumbing system.

Handle body 12, first handle member 14, second handle member 16 and head connector 18 can be manufactured out of a variety of different materials and made as a single integral unit or as separate components that interconnect to form handle 10. For instance, these components can be made out of wood, metals, plastics, composites and combinations of these and other materials. The principal criteria is that the components be sufficiently strong to withstand the likely forces to be imposed on handle 10, which could be as high of a momentary loading as 1,000 psi with incidences of overloading as high as 2,000 psi. Another important criteria is that the materials be chosen to be sufficiently corrosion resistant, which will depend on the intended use of handle 10, to be useful for the design life of the product. Aesthetic and comfort features also need to be considered. The use of wood and metals, as well as certain other materials, would require certain manipulations of the components to connect them together, which could result in a cost prohibitive product. A preferred method of manufacturing these components would be a moldable polymer, such as polyporpylene, polystyrene or polyethylene. Because of its tensile strength, memory, color sensitivity and cost effectiveness, a polyethylene material is a preferred material. The polyethylene can be mixed with various fillers, such as carbon fiber and glass. Handle body 12, first handle member 14 and second handle member 16 can be solid or tubular. For polymer materials, tubular components may have certain structural benefits over equivalently sized solid components. If desired, plunger handle 10 can be manufactured by injection molding, thermo-forming, vacuum forming, roto-molding or investment casting. For some purposes, roto-molding may be the manufacturing method of choice. The major advantage of roto-molding is that it avoids "draw-bars" or "mold faces" that retract out of the finished product and, therefore, allow for a more closed hollow in design.

Figure 2:
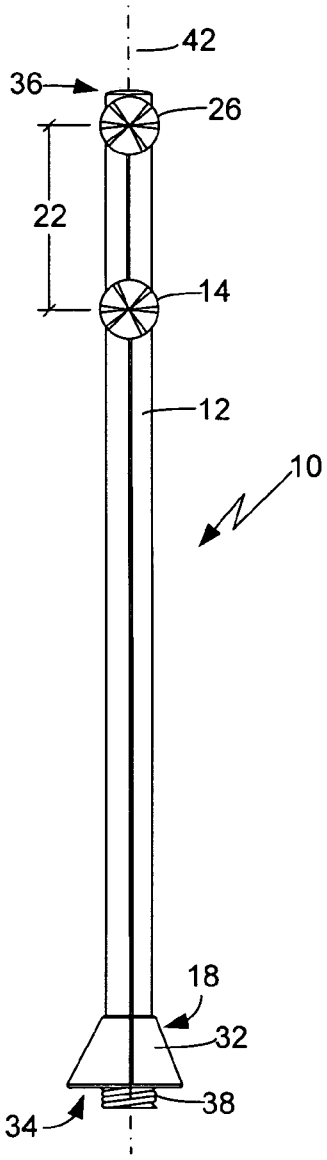
FIG. 2 is a side view of the drain plunger handle of FIG. 1.
Figure 3:
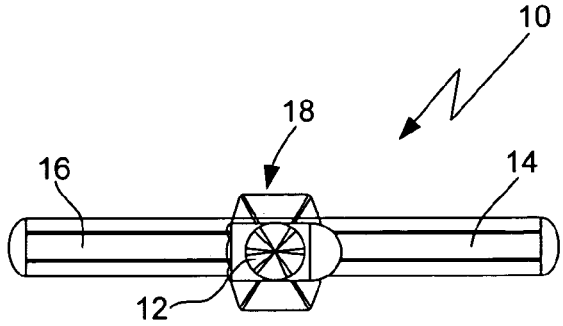
FIG. 3 is a top view of the drain plunger handle of FIG. 1.
Figure 4:
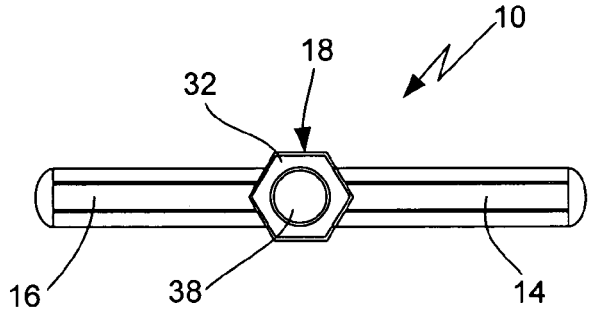
FIG. 4 is a bottom view of the drain plunger handle of FIG. 1.

As best shown in FIGS. 1 and 2, first handle member 14 and second handle member 16 are vertically spaced apart by vertical offset 22. The use of vertical offset 22 for first 14 and second 16 handle members provides a more ergonomic plunger handle 10 for the user's hands to allow the user to much more comfortably exert greater downward force on handle 10 so as to cause plunger head 20 to create a more rapid and greater positive and negative surge of water flow in the plumbing system. This surge of water flow acts as a turbulent pulse of water to dislodge the obstruction in the plumbing system. This configuration results in a much improved plunger handle than the conventional pole-type handle that requires the user to grip the handle with his or her hands placed vertically on the pole handle to push the handle downward to pulse the plunger head. With the plunger handle 10 having first 14 and second 16 handle members with vertical offset 22, the user can push directly downward on handle members 14 and 16 to pulse the plunger head 20. In one configuration, vertical offset 20 is approximately three to five inches, with preferred vertical offset 22 being about four inches. Depending on the anticipated uses of a drain plunger having plunger handle 10, it may be beneficial to have more or less vertical offset 22.

Figure 5:
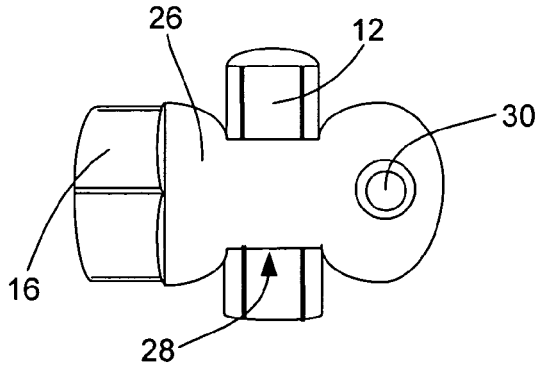
FIG. 5 is a isolated view of the connection between the handle body and the handle members of the drain plunger handle of FIG. 1.

As stated above first 14 and second 16 handle members can be made integral with handle body 12. Alternatively, first 14 and second 16 handle members can be configured to fixedly attach to handle body 12, as shown in FIGS. 1 and 5. First handle member 14 has a first member connector 24 that attaches to handle body 12 below second handle member 16, which attaches to handle body 12 by second member connector 26. First 24 and second 26 member connectors can comprise a clamping mechanism to securely clamp onto handle body 12 after handle body 12 is inserted through a hole 28 in first 24 and second 26 member connectors, as best shown in FIG. 5. A securing mechanism 30, such as a screw, bolt or like devices, can be utilized to attach first 24 and second 26 member connectors to handle body 12. Alternatively, securing mechanism 30 for first 14 and second 16 handle members can be an adhesive or other non-mechanical mechanism suitable for attaching handle members 14 and 16 to handle body 12. If desired, first 14 and second 16 handle members can be slidably attached to handle body 12 to allow the user to adjust the placement of handle members 14 and 16 on handle body 12 and the amount of vertical offset 22 that is most comfortable and/or useful for them. In such a configuration, securing mechanism 30 should be of the type that allows the user to release and tighten the connection between handle body 12 and first 24 and/or second 26 member connectors (as desired).

In the preferred embodiment, as shown in the figures, the centerline of first 14 and second 16 handle members are substantially in the same vertical plane, such that they extend outwardly from handle body 12, in perpendicular relationship to handle body 12, in opposite directions from each other. This configuration is likely to result in the least amount of stress on handle body 12 and first 14 and second 16 handle members. The first 14 and second 16 handle members and the first 24 and second 26 member connectors must be configured to be able to withstand the rotational forces resulting from the moment stress placed on the plunger handle 10 when in use. First 14 and second 16 handle members should be sized and configured to fit comfortably in the user's hand and to be able to withstand the forces to be exerted thereon when utilized to clear an obstruction from the plumbing system. In one configuration, handle members 14 and 16 extend approximately seven to eight inches from handle body 12 and are approximately three-fourths to one inch in diameter. Naturally, different sizes may be useful depending on the anticipated use or users of plunger handle 10. In one configuration, handle body 12 also has a diameter of approximately three-fourths to one inch and a length of 28 to 36 inches. If desired, to achieve aesthetic and/or stress reduction benefits, the cross-section of handle body 12 can vary along its length.

As stated above, head connector 18 is configured to attach to plunger head 20. In the preferred embodiment, plunger head 20 removably attaches to head connector 18 so the user can change plunger head 20 as desired or necessary. As shown in the embodiment of FIGS. 1 and 2, head connector 18 comprises a connector body 32 at the first end 34 of elongated handle body 12, opposite first 14 and second 16 handle members which are generally disposed near the second end 36 of handle body 12. Attached to connector body 32 is threaded post 38, which is configured to threadably connect to threaded inlet 40 of plunger head 20. In this manner, threaded post 38 can be threaded into threaded inlet 40 to connect plunger head 20 to handle body 12. As known to those skilled in the art, threaded post 38 should generally be disposed along the longitudinal axis 42, shown in FIG. 2, of elongated handle body 12. Preferably, the connection between head connector 18 and plunger head 20 is robust in nature but allow the plunger head 20 to be quickly detached from handle body 12 as desired. A threaded connection has the benefit of transmitting relatively large vertical loads to the plunger head 20 by displacing the load over several thread bearing surfaces. As stated above, head connector 18 can be manufactured to be integral with handle body 12 or head connector 18 can be a separate component that fixedly attaches to handle body 12. Although not preferred, plunger head 20 can also be manufactured to be integral with plunger handle 10.

In use with the preferred embodiment of drain plunger handle 10 of the present invention, the user first attached plunger head 20 to plunger handle 10 by, in the preferred embodiment shown in the figures, threading threaded post 38 of head connector 18 on handle body 12 into threaded inlet 40 of plunger head 20. Once plunger head 20 is connected to plunger handle 10, the user places plunger head 20 over the drain, such as a toilet, shower or bathtub drain, such that plunger head 20 can substantially seals around the drain. The user then places his or her hands on first 14 and second 16 handle members and applies a downward force to expel pressurized fluid (i.e., air and water) toward the obstruction in the plumbing system. With the vertical offset 22, the user can comfortably place his or her hands on plunger handle 10 and apply a somewhat significant force to the plunger head 20 in an ergonomically beneficial manner to obtain the up and down movement necessary to create the positive and negative pressure surges to remove the obstruction from the plumbing system. If necessary or desired, depending on the type of plunger head 20 utilized, the user can twist or rotate plunger handle 10 for more optimum operation. The offset nature of first 14 and second 16 handle members on plunger handle 10, the user can more comfortably apply more force than he or she could with other drain plungers.

While there are shown and described herein certain specific alternative forms of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to the dimensional relationships set forth herein and modifications in assembly, materials, size, shape and use.

What is claimed is:

1. A drain plunger handle for use with a plunger head, said drain plunger handle comprising:

an elongated handle body having a first end and a second end;

a first handle member attached to said handle body, said first handle member extending outwardly from said handle body in a generally first perpendicular direction;

a second handle member attached to said handle body, said second handle member attached to said handle body so as to have a vertical offset between said first handle member and said second handle member, said second handle member extending outwardly from said handle body in a generally second perpendicular direction substantially opposite said first perpendicular direction, said vertical offset fixed when said first handle member and said second handle member are attached to said handle body and during use of said drain plunger handle; and a head connector at said first end of said handle body, said head connector adapted to connect said handle body to said plunger head.

2. The drain plunger handle according to claim 1, wherein said first handle member comprises a first member connector connecting said first handle member to said handle body and said second handle member comprises a second member connector connecting said second handle member to said handle body, said first member connector and said second member connector are slidably disposed on said handle body, each of said first member connector and said second member connector having means for securing said first member connector and said second member connector to said handle body.

3. The drain plunger handle according to claim 1, wherein said head connector is configured to removably connect to said plunger head.

4. The drain plunger handle according to claim 3, wherein said head connector comprises a connector body attached to said handle body and a threaded post extending outwardly from said connector body along a longitudinal axis of said handle body, said threaded post adapted to be threadably received in said plunger head.

5. The drain plunger handle according to claim 1, wherein said head connector comprises a connector body attached to said handle body and a threaded post extending outwardly from said connector body along the longitudinal axis of said handle body, said threaded post adapted to be threadably received in said plunger head.

6. The drain plunger handle according to claim 1, wherein said first handle member and said second handle member are substantially in the same vertical plane.

7. A drain plunger handle for use with a plunger head, said drain plunger handle comprising:

an elongated handle body having a first end and a second end;

a first handle member;

a first member connector attached to said first handle member and slidably disposed on said handle body, said first handle connector adapted to attach said first handle member to said handle body and extend said first handle member outwardly from said handle body in a generally first perpendicular direction;

means for securing said first member connector to said handle body;

a second handle member;

a second member connector attached to said second handle member and slidably disposed on said handle body, said second handle connector adapted to attach said second handle member to said handle body and extend said second handle member outwardly from said handle body in a generally second perpendicular direction substantially opposite said first perpendicular direction;

means for securing said second member connector to said handle body, said second member connector attached to said handle body so as to provide a vertical offset between said first handle member and said second handle member, said vertical offset fixed upon attachment of said first member connector and said second member connector to said handle body and during use of said drain plunger handle; and a head connector at said first end of said handle body, said head connector adapted to connect said handle body to said plunger head.

8. The drain plunger handle according to claim 7, wherein said head connector is configured to removably connect to said plunger head.

9. The drain plunger handle according to claim 8, wherein said head connector comprises a connector body attached to said handle body and a threaded post extending outwardly from said connector body along a longitudinal axis of said handle body, said threaded post adapted to be threadably received in said plunger head.

10. A drain plunger handle for use with a plunger head, said drain plunger handle comprising:

an elongated handle body having a first end and a second end;

a first handle member;

a first member connector adapted to attach said first handle member to said handle body and extend said first handle member outwardly from said handle body in a generally first perpendicular direction;

a second handle member generally disposed in the same vertical plane as said first handle member;

a second member connector adapted to attach said second handle member to said handle body and extend said second handle member outwardly from said handle body in a generally second perpendicular direction substantially opposite said first perpendicular direction, said second handle member attached to said handle body with a vertical offset between said first handle member and said second handle member, said vertical offset fixed when said first handle member and said second handle member are attached to said handle body and during use of said drain plunger handle; and a head connector at said first end of said handle body, said head connector adapted to removably connect said handle body to said plunger head; said head connector having a connector body attached to said handle body and a threaded post extending outwardly from said connector body along a longitudinal axis of said handle body, said threaded post adapted to be threadably received in said plunger head.

* * * * *